US005823346A

United States Patent [19]

Weiner

[11] Patent Number: 5,823,346

[45] Date of Patent: Oct. 20, 1998

[54] MEDICINE BOTTLE REMINDER ATTACHMENT

[76] Inventor: Steven L. Weiner, 3180 Crow Canyon Pl., Suite 127, San Ramon, Calif. 94583

[21] Appl. No.: 910,491

[22] Filed: Aug. 6, 1997

Related U.S. Application Data

[63] Continuation-in-part of Ser. No. 905,477, Aug. 4, 1997.

[51] Int. Cl.[6] ..... B65D 83/04

[52] U.S. Cl. ..... 206/534; 206/459.1

[58] Field of Search ..... 215/6, 230, DIG. 3; 206/528, 534, 538, 459.1, 459.5; 116/306, 307, 308, 67 R

[56] References Cited

U.S. PATENT DOCUMENTS 5,577,335 11/1996 Tucker ..... 206/534 X
5,711,425 1/1998 Trimble-Gomez ..... 206/534 X

*Primary Examiner*—Jacob K. Ackun
*Attorney, Agent, or Firm*—Bielen, Peterson & Lampe

[57] ABSTRACT

A medicine bottle with an integral medicine dosage reminder forming a medicine bottle unit, the unit has a medicine bottle with a bottom having a skirt extension with a window for viewing an indicator label on an indicator ring. The indicator ring is inserted in the skirt extension and pivotal therewith to position a selected label marking in the window of the extension skirt. In one embodiment a timer is included to signal the time to take medication by an audible alarm.

8 Claims, 2 Drawing Sheets

MEDICINE BOTTLE REMINDER ATTACHMENT

BACKGROUND OF THE INVENTION

This application is a continuation-in-part of my application Ser. No. 08/905,477 filed Feb. 26, 1996 entitled, Medicine Bottle Reminder Attachment.

The present invention relates to the field of indicators and more specifically to a dosage reminder for a medicine bottle.

Medicine is dispensed in a variety of containers, typically a glass or plastic bottle for liquids, or a substantially cylindrical container for pills or capsules. The medicine can be either prescription medicine or nonprescription (over-the-counter) medicine. Whatever the medicine, if it must be taken at regular intervals, a problem exists in reminding the taker when the next dose is to be taken whether the current dose has already been taken.

Many variations of reminder devices are known in the art, and can be generally divided into two categories: the individual bin reminder device contains multiple bins, one per dosage, with the bins labelled according to when the dosage in that bin is to be taken (e.g., "Mon", "Tue", "Wed", . . . , or "1", "2", "3", . . . ). Some individual bin reminder devices are sold separate from the medicine and it is up to the user to insert the dosages into the bins, while some medicines, particularly oral contraceptives and heart medicines, are sold in packages with the dosages already allocated to labelled bins.

Bottle reminders do not separate out the dosages, but just indicate when the next dosage is to be taken from the bottle or when the last dosage was taken. An example of a bottle reminder device is shown in U.S. Pat. No. 5,433,324 issued to Leonard. The Leonard medicine reminder device has concentric time and date indicator rings attached to a base, where the base has a reference mark imprinted thereon to indicate the time of the next dosage in combination with the indicator rings. The indicator rings are rotated so that the reference mark points to the time of next dosage. The base includes a central cylindrical cavity into which a medicine bottle is placed. The size of the central cavity is chosen such that bottles of various sizes and shapes can be accommodated. The Leonard device is separable from the medicine bottle and thus would be typically sold to consumers separate from the medicine and used over and over by the user for different medicines.

Because the Leonard device can be reused often, cost of manufacture is not much of a concern. Predictably, the Leonard device is not very amenable to being manufactured cheaply enough to be included with each prescription. This limits its usefulness as a device provided as an additional service of a pharmacy or pharmaceutical bottle distributor. Instead, the user is expected to purchase one of the Leonard devices separately and consequently might fail to purchase and use the reminder device on particularly important medicines. Another disadvantage of the Leonard device is that it is not designed to be secured to the medicine bottle.

U.S. Pat. No. 4,440,045 issued to Villa-Real shows a automatic medication time-interval reminder cap and container which partially overcomes the problems of the Leonard reminder device, as the cap of the Villa-Real reminder could be included with purchase of a prescription by a pharmacist who decides, on a case by case basis, whether the prescription warrants a reminder device. However, the Villa-Real cap is difficult to manufacture and therefore would tend to be an expensive addition to a bottle. Furthermore, the Villa-Real cap is limited to use with medicine bottles specifically configured to accept such a cap.

With these problems, it is clear that none of the devices in the prior art provide a medicine dosage reminder which is inexpensive to manufacture and can be either provided as an option by a pharmacy on premanufactured bottles or provided by the bottle manufacturer as part of the medicine bottle.

SUMMARY OF THE INVENTION

An inexpensive dosage reminder is provided by virtue the present invention.

In a preferred embodiment, a medicine bottle is created with a skirt extension, into which an indicator ring is inserted. The indicator ring can be added by the medicine bottle manufacturer or the retailer of the medicine dispensed in the bottle. In this embodiment, the indicator ring is secured to the medicine bottle by tabs which have capture features which fit under a rim of the indicator ring. The indicator ring has a series of detents below the rim which, combined with the capture features, cause indicator labels in the indicator ring to be centered in a window cut in the skirt extension when the tabs rest in the detents. In a specific embodiment, the abbreviations are preprinted on the indicator ring to be centered in a window cut in the skirt extension when the tabs rest in the detents. In a specific embodiment, the abbreviations are preprinted on the indicator ring for each day of the week and the numbers 1 through 12 to denote hours or dose counts. With both sets of labels, the indicator ring is a universal indicator ring in that it can be used on a medicine bottle regardless of the dosage period. Of course, medicine bottles of different diameters will require different indicator ring sizes.

Further understanding of the nature and advantages of the present invention may be realized by reference to the remaining portions of the specification and the attached drawings.

DETAILED DESCRIPTION OF THE PREFERRED EMBODIMENTS

Figure 1:
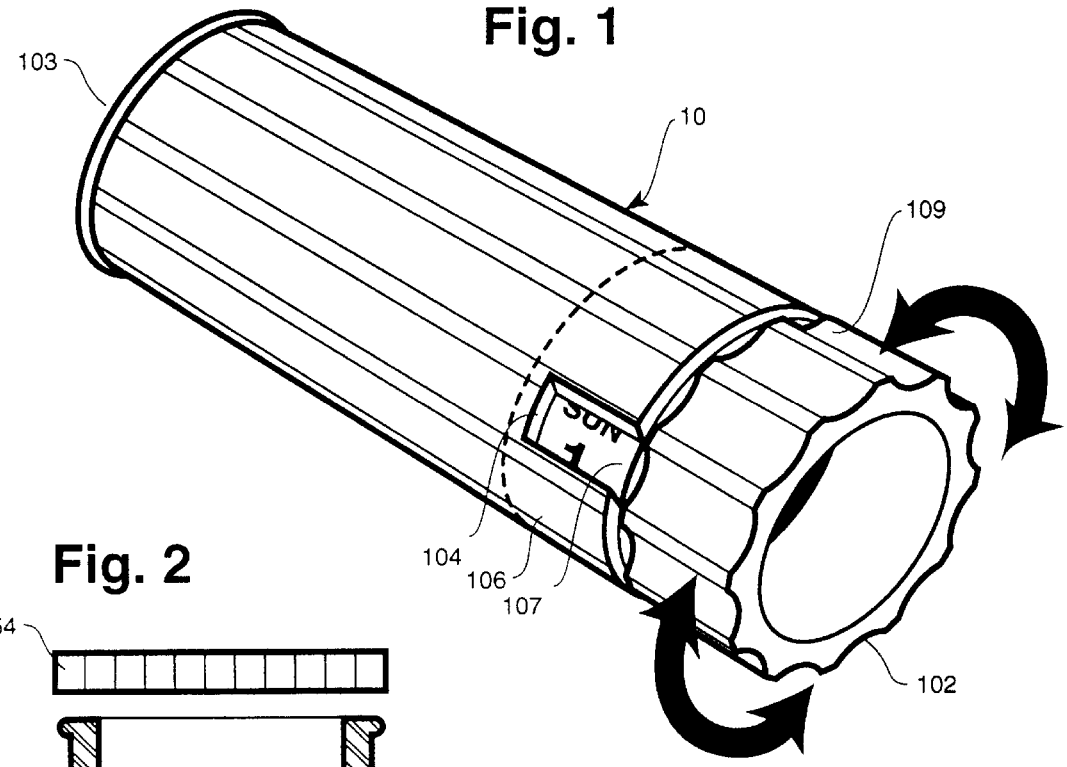
FIG. 1 is a perspective view of the dosage reminder bottle unit according to the present invention.

Referring to FIGS. 1–8 a preferred embodiment of the medicine dosage reminder is shown. The medicine bottle with the integral medicine dosage reminder is hereinafter called the medicine bottle unit 10. In FIG. 9 the mechanical medicine bottle is designated by the reference numeral 120 and includes an electronic timer to provide an audio as well as a visual reminder.

FIG. 1 shows the medicine bottle unit 10 comprising a medicine bottle 100 with an indicator ring 102 attached thereto. Medicine bottle 100 is formed as a cylindrical container 101 with an open top 103 and a bottom 105 having a window 104 in a skirt extension 106 for viewing an indicator label 107 printed on indicator ring 102. Medicine bottle 100 is easily constructed out of plastic using a conventional injection molding process, or it can be formed using any one of a number of other manufacturing processes. The medicine bottle 100 can be filled with a standard pop-off cap or a special safety cap as customary. Indicator ring 102 can also be made by injection molding and imprinted with an indicator label 107 as shown in FIG. 1 (and shown in greater detail in FIG. 8). Indicator ring 102 is constructed with a large knurled base 109 to make indicator ring 102 easy to grasp and turn.

In the expected manner of use, medicine bottle 100 is distributed to pharmacies for packaging of medicines. Where a customer does not request a dosage reminder, the pharmacist simply dispenses the prescription in a medicine bottle 100 without including indicator ring 102. Where a customer requests a dosage reminder, or where a pharmacy has a policy to always include a dosage reminder, the pharmacist attaches the indicator ring 102 to the bottom of medicine bottle 100, selecting the appropriate size indicator ring. Since indicator ring 102 is universal, the pharmacist need not fumble around among several indicator rings for the particular medicine bottle.

Figure 2:
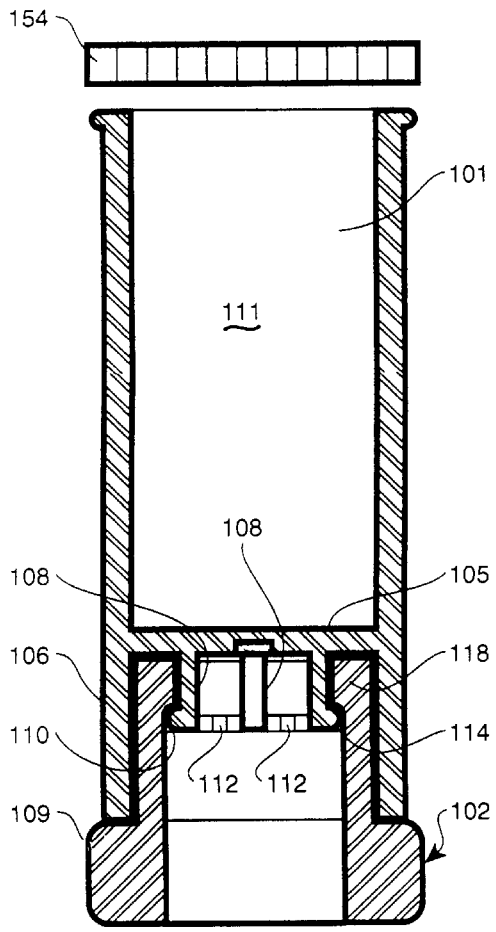
FIG. 2 is a cross sectional view of the medicine bottle and indicator ring shown in FIG. 1 with a typical cap.
Figure 3:
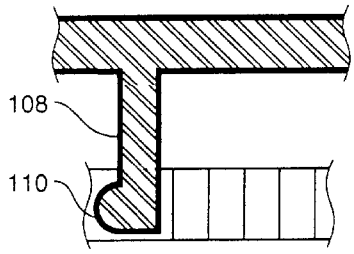
FIG. 3 is a close-up view of the capture shown in FIG. 2.

FIG. 2 is a cross sectional view of medicine bottle 100 showing the container portion 111 and how indicator ring 102 is attached to medicine bottle 100. In addition to skirt extension 106 which extends beyond the bottom 105 of medicine bottle 100, several tabs 108 molded from the bottom of medicine bottle 100 are also present. In the embodiment described in these figures, five tabs 108 are provided and are evenly spaced from the circumferential wall 113 along a circle concentric with the axis of medicine bottle 100 (see FIG. 6). These tabs 108 serve to secure indicator ring 102 to the bottom of medicine bottle 100 by having a capture protuberance 110 (see FIG. 3) at the end of each tab 108. These tabs 108 flex to fit over the rim 118 to enable the capture protuberance 110 engage detents 112, as shown in greater detain in FIG. 7. Tabs 108 are made of a flexible material to allow a capture protuberance 110 to move towards the axis of medicine bottle 100 when indicator ring 102 is inserted, and to spring away from the axis when lip 114 has passed capture protuberance 110 along the insertion path of indicator ring 102. Capture protuberance 110 also serves to center the indicator labels in window 104, since capture feature 110 rides below lip 114 and presses against detents 112.

Figure 4:
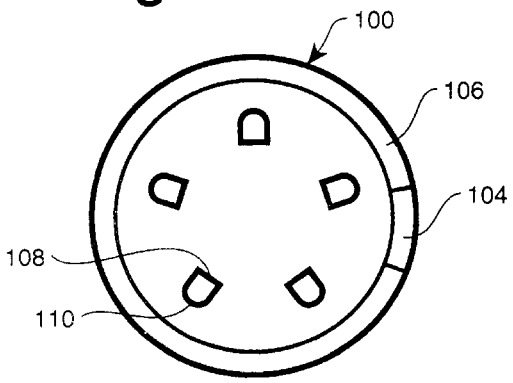
FIG. 4 is a bottom view of the medicine bottle shown in FIG. 1 without an indicator ring.

Referring now to FIG. 4, a bottom view of medicine bottle 100 without indicator ring 102 shows tabs 108 and their relative spacing. The positions of tabs 108 are selected such that an indicator label is centered in window 104 when a capture feature 110 is centered in a detent 112 (see FIGS. 3 and 7).

Figure 5:
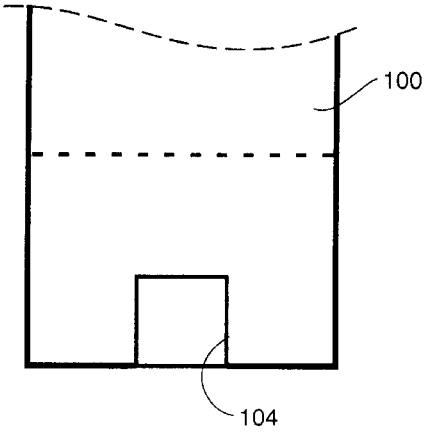
FIG. 5 is a partial side view of the medicine bottle shown in FIG. 1 without the indicator ring, showing the indicator window.

FIG. 5 is a side view of medicine bottle 100 without indicator ring 102, more clearly showing aperture or how window 104 appears relative to skirt extension 106.

Figure 6:
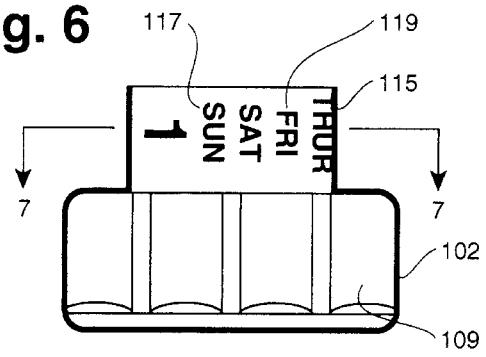
FIG. 6 is a side view of the indicator ring shown in FIG. 1 without the medicine bottle.
Figure 7:
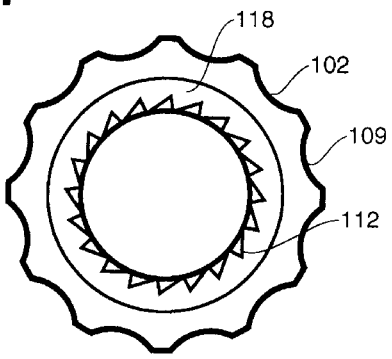
FIG. 7 is a top cross sectional view of the indicator ring taken on the lines 7—7 in FIG. 6.
Figure 8:
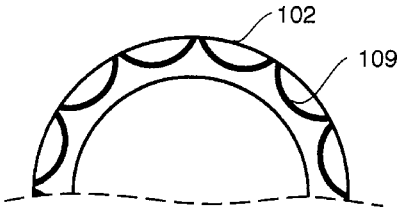
FIG. 8 is a partial bottom view of the indicator ring shown in FIGS. 5–7.
Figure 9:
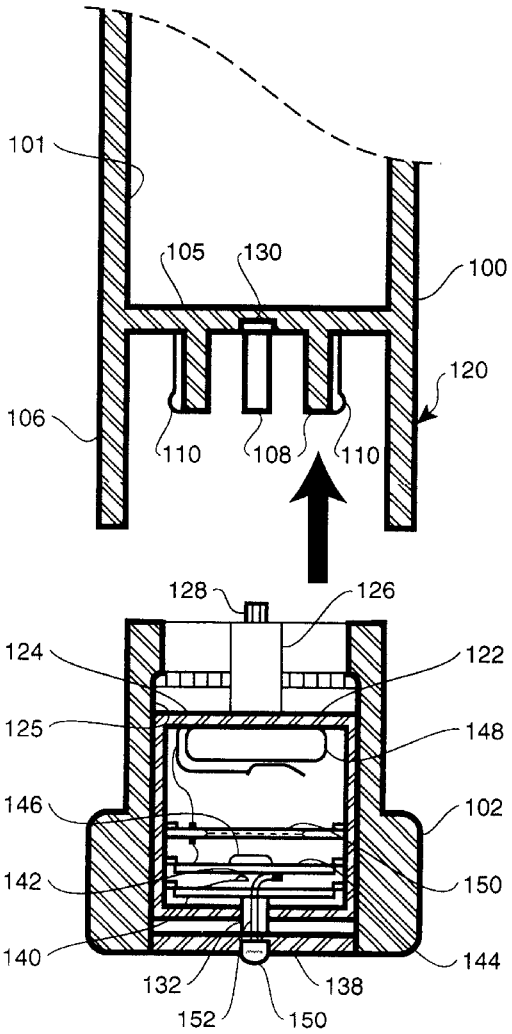
FIG. 9 is a partial, cross sectional, exploded view of an alternate embodiment of the dosage reminder bottle unit having an electronic alarm.

FIGS. 6–8 show indicator ring 102 separate from medicine bottle 100. FIG. 6 shows a side view of indicator ring 102, more clearly showing a ring portion 115 with preprinted indicator label 119 thereon. The label need not be preprinted, but can be printed on indicator ring 102 after its manufacture or can be simply pressed into the plastic of the ring portion 115 of indicator ring 102 when manufactured.

FIG. 7 is a top cutaway view of indicator ring 102 showing detents 112 in the inner rim of indicator ring 102. In FIG. 7 a topmost retaining rim 118 (see FIG. 2) is cut away so that detents 112 can more clearly be seen. In this specific embodiment, twenty equally-spaced detents 112 are used. Because detents 112 are evenly spaced and tabs 108 (see FIG. 4) are also evenly spaced and the number of detents 112 is an even multiple of the number of tabs 108, each of the protuberances 110 of the tabs 108 settles into a detent 112 when the other tabs settle into other detents. This allows for easy alignment of an indicator label marking 117 with window 104. The indicator label markings 117 are the days of the week and the numbers 1 through 12 to represent hours for typical indicator markings may be provided. Have, only nineteen total indicator label positions are used, so the twenty position indicator ring will have one blank or special purpose position, for example, the "off" position in the embodiment of FIG. 9.

FIG. 8 is a partial bottom view of indicator ring 102 more clearly showing the knurled grasping portion or base 109. In indicator ring 102 shown in FIGS. 7 and 8, there are twelve evenly-spaced knurled regions.

Referring to FIG. 9, the medicine bottle unit 120 includes the elements as previously designated with the addition of an electronic alarm module 122. As shown in the cross-sectional view of FIG. 9, the electronic module 122 includes a housing 124 that fits into a cavity 125 of the indicator ring 102. The housing 124 has a projecting pin 126 with a key 128 that engages a keyway 130 in the bottom 105 of the bottle 100 to which the indicator ring 102 is connected. In this manner, the housing 124 remains stationary with respect to the bottle when the indicator ring 102 is rotated.

The housing also includes an end hole 132 through which a journal pin 136 projects. The pin journal 136 connects to an end cap 138 fixed to the end of the rotating ring 102 such that the pin 136 and a connected rotary contact plate 140 rotate with respect to the housing 124 when the ring is rotated. The rotating contact plate 140 has a brush 142 that contacts a divided conductor surface (not visible) on a circuit board 144 to register the selection made in the window 104 of the medicine bottle 100. In this embodiment, the markings on the ring label represent the period between the time for taking medicine. One position may be an "off" position to conserve power or avoid the audible alarm signal.

The circuit board 144 includes a chip 146, an electronically coupled battery 148, and a thin diaphragm speaker 150. The chip 146 includes a timer circuit that generates an alarm signal each time the selected period of time has expired to provide an audible alarm that the medicine is to be taken. In addition, the journal pin 136 and cover plate 132 optionally includes a small light emitting diode 150 to provide a light signal as well as an audible alarm signal. The diode 150 is electronically connected to the circuit board 146 through a pair of filament wires 152.

Because of the simplicity in adding the electronic timer mechanism module 122 to the indicator ring 102, the installation can be made at the time the patient purchases medicine. In this manner, the same connecting structure can be provided for either the mechanical device alone or with the added timer. This option allows a pharmacist to select a mechanical or electronic end adjust the cost of the component and item with the prescription purchase. Additionally, the addition of the timer to the bottom of the medicine bottle unit 10 permits a standard pop-off cap 154 (FIG. 2) or a special safety cap (not shown) to be provided at the open end of the bottle 100. The alarm module 122 is of the type manufactured for key ring alarms to signal passage of a defined period of time. Such alarms are compact, inexpensive to manufacture, and may be modified for placement in a recess in a cylindrical medicine container.

In the foregoing specification, the invention has been described with reference to specific preferred embodiments and methods. It will, however, be evident to those of skill in the art that various modifications and changes may be made without departing from the broader spirit and scope of the invention as set forth in the attendant claims. The specification and drawings are, accordingly, to be regarded in an illustrative, rather than restrictive, sense; the invention being limited only by the appended claims.

What is claimed is:

1. A medicine bottle dosage reminder comprising:

a cylindrical container with an open top, a recessed bottom and a circumferential wall with a container portion between the bottom and open top and a skirt portion extending from the bottom, the skirt portion having an aperture;

an indicator member having a ring portion with an indicator label with a pluralility of label markings around the circumference of the ring portion and grasping portion, wherein the skirt portion of the container wall has an inside circumference, the ring portion of the indicator member having an outside circumference substantially equal to the inside circumference of the skirt portion of the container wall;

and, retainer means for rotatably retaining the ring portion of the indicator member in the skirt portion of the container wall when the ring portion of the indicator member is inserted into the skirt portion of the circumferential wall with the grasping portion extending from the skirt portion, wherein label markings selectively appear in the aperture on rotation of the grasping portion of the indicator member.

2. The medicine bottle, dosage reminder of claim 1 wherein the ring portion of the indicator member has an inside circumference with a retainer rim and the recessed bottom has a plurality of spaced, flexible tabs with ends having capture elements, the capture elements engaging the retaining rim when the ring portion of the indicator member is inserted in the skirt portion of the container wall.

3. The medicine bottle, dosage reminder of claim 2 wherein the inside circumference of the ring portion of the indicator member has a band of detent notches adjacent the retaining rim, the detent notches being engaged by the capture elements of the flexible tabs for incremental rotation of the indicator member.

4. The medicine bottle, dosage reminder of claim 1 wherein the grasping portion of the indicator member has an outside circumference greater than the inside circumference of the skirt portion of the container wall.

5. The medicine bottle, dosage reminder of claim 4 wherein the grasping portion of the indicator member has a knurled grasping surface.

6. The medicine bottle dosage reminder of claim 1, wherein the indicator portion has a cavity and the medicine bottle dosage reminder includes an electronic alarm module mounted within the cavity wherein the electronic alarm module generates an audible alarm signal.

7. The medicine bottle dosage reminder of claim 6 wherein the electronic alarm module has a time selection means connected to the indicator member for selecting an alarm period corresponding to a time period indicated by a label marking in the aperture.

8. A medicine bottle dosage reminder comprising:

a cylindrical container with an open top, a recessed bottom with a skirt portion extending from the bottom forming a cavity; and, an electronic alarm module mounted in the cavity wherein the alarm module has a rotatable stem selection means for selecting a time period, and audible alarm means for generating an audible alarm upon expiration of the time period selected.

* * * * *